US007753255B2

(12) United States Patent
Kieser

(10) Patent No.: US 7,753,255 B2
(45) Date of Patent: Jul. 13, 2010

(54) SHEET MATERIAL AND METHOD

(75) Inventor: Wolfgang Kieser, Hohenöllen (DE)

(73) Assignee: Elopak Systems AG, Glattbrugg (CH)

( * ) Notice: Subject to any disclaimer, the term of this patent is extended or adjusted under 35 U.S.C. 154(b) by 501 days.

(21) Appl. No.: 11/629,444

(22) PCT Filed: Jun. 22, 2005

(86) PCT No.: PCT/IB2005/001759

§ 371 (c)(1),
(2), (4) Date: Apr. 9, 2007

(87) PCT Pub. No.: WO2006/000881

PCT Pub. Date: Jan. 5, 2006

(65) Prior Publication Data

US 2007/0228128 A1 Oct. 4, 2007

(30) Foreign Application Priority Data

Jun. 23, 2004 (GB) ..... 0414029.9

(51) Int. Cl.
*B65D 5/54* (2006.01)
*B65D 5/74* (2006.01)

(52) U.S. Cl. ..... 229/125.15; 229/204; 229/125.14

(58) Field of Classification Search ..... 229/202, 229/123.2, 123.3, 125.35, 103, 103.1, 204, 229/125.14, 125.15
See application file for complete search history.

(56) References Cited

U.S. PATENT DOCUMENTS 2,950,814 A * 8/1960 Thomson, Jr. ..... 206/427
3,100,642 A * 8/1963 Goldstein ..... 229/103
3,933,297 A * 1/1976 Carlsson et al. ..... 229/125.35
4,491,224 A * 1/1985 Horvath ..... 229/125.35
4,533,063 A * 8/1985 Buchner et al. ..... 229/123.2
5,326,023 A * 7/1994 Rice et al. ..... 229/202

FOREIGN PATENT DOCUMENTS

DE 19936762 A1 * 2/2001
JP 11115932 A * 4/1999

* cited by examiner

*Primary Examiner*—Gary E Elkins
(74) *Attorney, Agent, or Firm*—Warn Partners, P.C.

(57) ABSTRACT

A top closure obturating panel (2) of a carton is formed with a partial depth cut (4) in the form of an open loop of which one end (4*a*) is at a greater distance from a central zone of the loop (4) than is the other end (4*b*). Following filling and top-sealing of the carton, there is applied to the panel (2) a pour spout fitment consisting of a flanged pour spout, a screw cap on the pour spout, and a plunger co-operating with the screw cap and the pour spout in such manner that, upon unscrewing of the screw cap, the plunger screws inwards. At its inner end, the plunger is formed with arcuate pushing blades (6), which thereby cause the laminate material of the panel (2) to fracture along the partial depth cut (4) such that an encircling portion (2*a*) of the panel (2) and an encircled portion (2*b*) within the loop (4) separate from each other along the loop (4), but remain interconnected by way of an intermediate portion (2*c*) extending through between the ends (4*a*) and (4*b*) of the loop (4).

11 Claims, 2 Drawing Sheets

SHEET MATERIAL AND METHOD

This invention relates to sheet material and to a method of forming a curved discontinuity in sheet material.

In form-fill-seal systems for liquid packaging cartons it is known to apply pour spout fitments to external surfaces of top closure obturating sub-panels, the pour spout fitments often consisting of flanged pour spouts having their flanges sealed to the external surfaces of the respective panels, screw caps having internally threaded skirts for co-operating with external screw-threading of the respective pour spouts, and plungers guided in the pour spouts such that, upon unscrewing of the screw caps, the plungers are urged downwardly to form pouring holes through the panels. It is known for such plunger to be so guided as to turn about its own axis as it descends and for the plunger to be formed at its inner end with at least one arcuate pushing blade co-axial with the plunger so as to push and even cut a part or all of a disc out of the panel in order to provide the pouring hole.

For aseptic packaging, such as for products to have long shelf lives, it is known to form cartons from laminate material comprised of a paperboard substrate, innermost and outermost moisture barrier layers, of low density polyethylene (LDPE) for example, and, between the paperboard substrate and the innermost moisture barrier layer, an oxygen barrier layer, of for example aluminium or ethylene vinyl alcohol (EVOH). Such oxygen barriers are relatively tough and so it is known to promote fracturing of the panel around the intended pouring hole by forming a partial depth cut around the intended pouring hole. This partial depth cut is normally through the outermost moisture barrier layer and through at least part of the thickness of the paperboard substrate, but does not penetrate the oxygen barrier layer. The partial depth cut is in the form of either a closed circular loop or an open loop of constant radius, in which latter instance the ends of the open loop terminate short of each other. The latter, of which an example is disclosed in WO-A-03/002419, is the more desirable, since then the sheet material portion around which the loop extends tends not to drop away into the liquid in the carton and, possibly, later obstruct the pouring of the liquid from the carton. However, in those circumstances the angular orientation of the pour spout fitment about its own axis relative to the carton needs to be correctly obtained upon attaching of the fitment to the carton panel since otherwise the turning cutting blade (or one of the turning cutting blades if more than one is provided) may push or even cut through the arcuate uncut portion between the ends of the open loop, so that a disc of severed laminate material falls into the liquid in the carton. Moreover, it has been found to be desirable to locate the loop ends at the "twelve o'clock" position on the top closure panel and this militates against flexibility in positioning of the open loop relative to the carton.

According to one aspect of the present invention, there is provided sheet material formed with a partial depth cut in the form of an open loop of which one end is at a greater distance from a central zone of said loop that is the other end thereof.

According to another aspect of the present invention, there is provided a method of forming a curved discontinuity in sheet material, comprising displacing an encircling portion of said material and an encircled portion thereof relative to each other such that the encircling portion and the encircled portion separate from each other along an open loop of which one end is at a greater distance from a central zone of said loop than is the other end thereof, but remain interconnected by way of an intermediate portion of said material extending through between the ends of said loop.

Owing to the invention, the loop-form partial depth cut or loop-form separation is not such as to enable an encircled portion to be totally separated from an encircling portion of the sheet material.

Advantageously, the ends of the open loop overlap each other. This has the advantage that the intermediate portion by way of which the encircling portion and the encircled portion are interconnected tends to be weaker than would be the case if those ends were not to overlap, with the result that the encircled portion has a reduced tendency to return to its original position.

In relation to the present method, it is advantageous, but not essential, that there should be a partial depth cut in the form of the open loop in order to promote formation of the appropriate loop of separation.

In order that the invention may be clearly and completely disclosed, reference will now be made, by way of example, to the accompanying drawing, in which, FIG. 1 is a fragmentary top plan view of a top closure obturating panel of a liquid packaging carton of gable-top, slant-top or flat-top character, prior to application of a pour spout fitment thereto;

Figure 1:
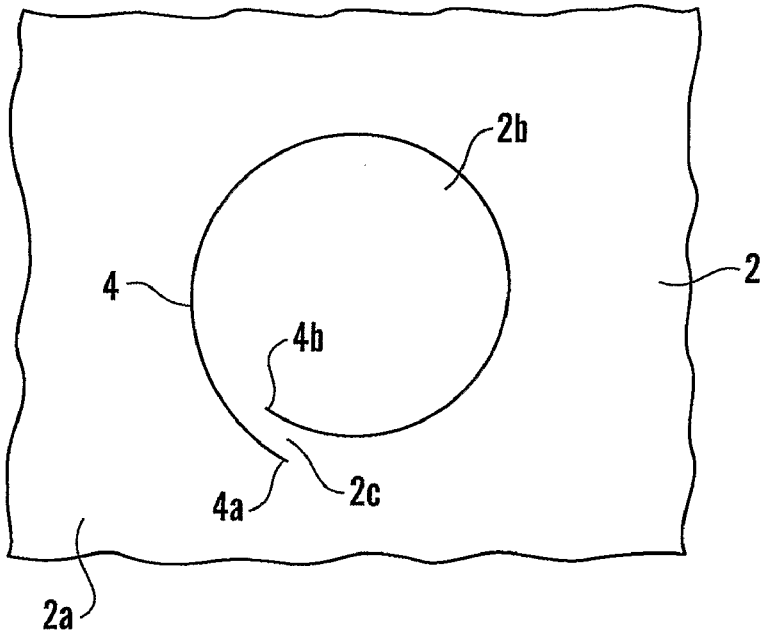
Figure 2:
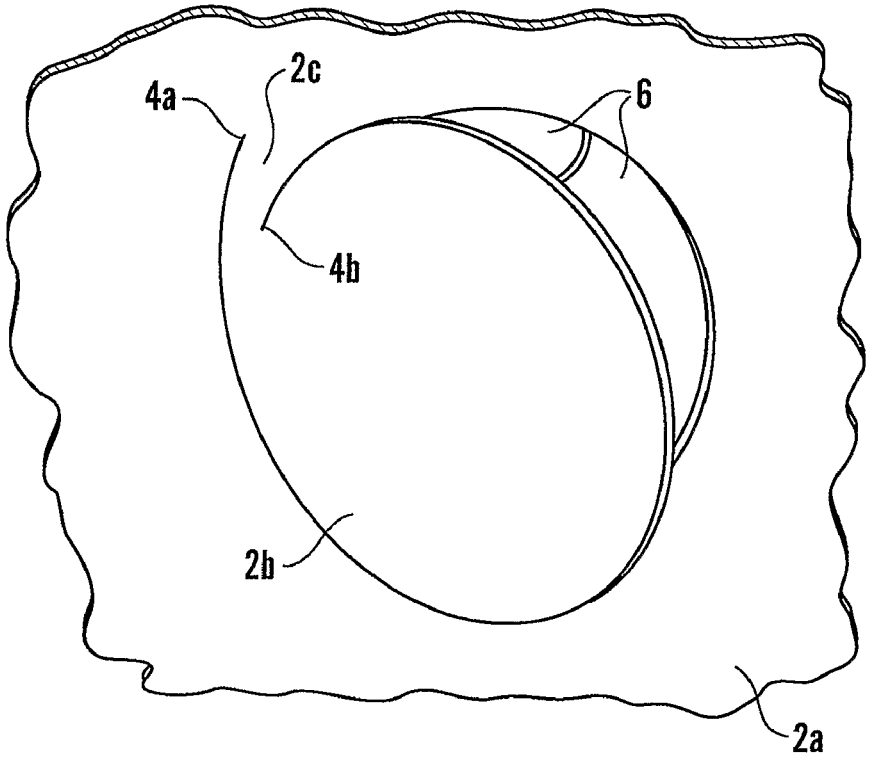
FIG. 2 is an underneath, fragmentary perspective view of the panel after opening of the carton, pusher blades of a plunger of a pour spout fitment being also seen.
Figure 3:
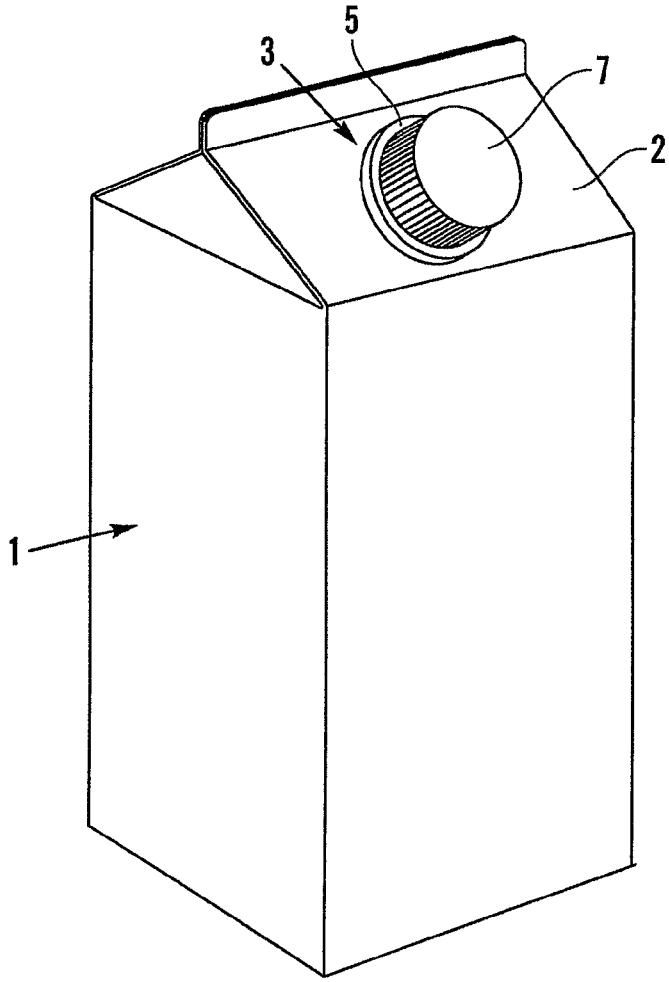
FIG. 3 is a perspective view from above of a gable-top carton with the pour spout fitment applied thereto.
Figure 4:
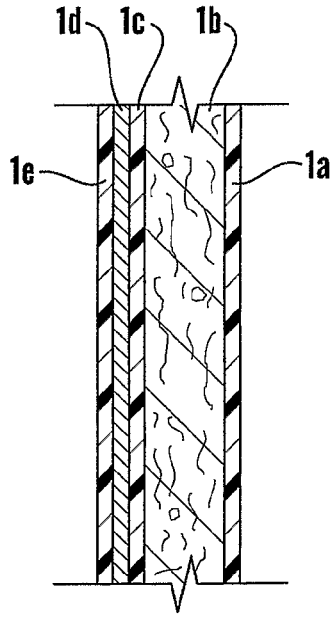
FIG. 4 shows a cross-section through sheet material of the carton.

Referring to the drawings, the top closure obturating panel 2 of the carton 1 is formed with a partial depth cut 4 through the outermost moisture barrier layer and at least part of the paperboard substrate, but not penetrating the oxygen barrier layer, of laminate packaging material consisting, progressing from the exterior of the carton to the interior thereof, of at least a moisture barrier layer 1*a*/paperboard substrate 1*b*/tie layer 1*c*/oxygen barrier layer 1*d*/moisture barrier layer 1*e*. The partial depth cut has been formed in the laminate material before filling of the carton 1, for example during cutting of the carton blank from a web of the laminate material. The knife used for forming the partial depth cut 4 is of a corresponding shape and size to that cut 4. As can be seen from FIG. 1, the partial depth cut 4 is in the form of an open loop of which one end 4*a* is at a greater distance from a central zone of the loop 4 than is the other end 4*b* thereof. The open loop 4 may be such that, progressing from the end 4*b* thereof, the loop is of a constant radius through about 270°, where that part-circle then merges into a part-circle of a larger radius for about 110° to the end 4*a*, so that the ends 4*a* and 4*b* overlap each other.

Following filling and top-sealing of the carton 1, there is then applied to the top surface of the panel 2 a pour spout fitment 3 consisting of a flanged pour spout 5, a screw cap 7 on the pour spout, and a plunger co-operating with the screw cap 7 and the pour spout 5 in such manner that, upon unscrewing of the screw cap 7 from the pour spout 5, the plunger is simultaneously displaced axially inwards and rotates about its own axis relative to the carton 2. At its inner end, the plunger is formed with arcuate pushing blades 6, which thereby turn about the axis of the fitment 3 while advancing axially inwards and so cause the laminate material of the panel 2 to fracture along the partial depth cut 4 such that an encircling portion 2*a* of the panel 2 and an encircled portion 2*b* of the panel 2 within the loop 4 separate from each other along the loop 4, but remain interconnected by way of an intermediate portion 2*c* of the panel 2 extending through between the ends 4*a* and 4*b* of the loop.

The preferred embodiment described with reference to the drawing has the following advantages. When the carton 1 is opened, the encircled portion 2*b* will not be completely separated from the encircling portion 2*a* but hang down from the intermediate portion 2*c*. Particular angular orientation of the partial depth cut about its own axis relative to the carton 1 is not necessary, nor is particular angular orientation of the pour spout fitment 3 about its own axis relative to the carton 2, since the pusher blades 6 can in fact start their action at any points on the 360° circle about the central zone of the loop 4. The partial depth cut 4 can be of a size and shape to suit any practical internal diameter of the pour spout fitment 3.

The invention claimed is:

1. Packaging sheet material including a top closure obturating panel for having a pour spout fitment subsequently applied thereto, said panel being formed with a partial depth cut in the form of an open loop of which one end is at a greater distance from a central zone of said loop that is the other end thereof, said material comprising, between outermost and innermost layers of plastics, a paperboard substrate, and, between said substrate and the innermost layer of plastics, an oxygen barrier layer, said partial depth cut being through the outermost layer of plastics and at least part of the thickness of the substrate.

2. Packaging sheet material according to claim 1, wherein the ends of the open loop overlap each other.

3. Packaging sheet material according to claim 1, wherein said open loop comprises first and second part-circles which merge into each other and of which the second part-circle is of greater radius than is the first part-circle.

4. Packaging sheet material according to claim 1 and in the form of a carton.

5. A method of forming a pouring hole through a wall of a container, said wall being of sheet material, and said method comprising displacing an encircling portion of said wall and an encircled portion thereof relative to each other such that the encircling portion and the encircled portion separate from each other along an open loop of which one end is at a greater distance from a central zone of said loop than is the other end thereof, but remain interconnected by way of an intermediate portion of said wall extending through between the ends of said loop.

6. A method according to claim 5, wherein the ends of the open loop overlap each other.

7. A method according to claim 5, wherein said open loop comprises first and second part-circles which merge into each other and of which the second part-circle is of greater radius than is the first part-circle.

8. A method according to claim 5, and further comprising, prior to said displacing, forming in said material a partial depth cut in the form of said open loop.

9. A method according to claim 8, wherein said material comprises, between outermost and innermost layers of plastics, a paperboard substrate, and, between said substrate and the innermost layer of plastics, an oxygen barrier layer, said partial depth cut being through the outermost layer of plastics and at least part of the thickness of the substrate.

10. A method according to claim 5, wherein said container is in the form of a carton.

11. A package comprising:

a carton including a top closure obturating panel, said panel being formed with a partial depth cut in the form of an open loop of which one end is at a greater distance from a central zone of said loop than is the other end thereof, and a pour spout fitment comprising a pour spout encircling said open loop and a plunger turnable and movable axially relative to said pour spout to break open said panel at said partial depth cut.

* * * * *